US007591280B2

(12) United States Patent
Narita et al.

(10) Patent No.: US 7,591,280 B2
(45) Date of Patent: Sep. 22, 2009

(54) MANIFOLD-TYPE SOLENOID VALVE ASSEMBLY

(75) Inventors: Masaru Narita, Tsukubamirai (JP); Makoto Ishikawa, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 533 days.

(21) Appl. No.: 11/448,908

(22) Filed: Jun. 8, 2006

(65) Prior Publication Data

US 2006/0283509 A1 Dec. 21, 2006

(30) Foreign Application Priority Data

Jun. 20, 2005 (JP) ..... 2005-179429
May 25, 2006 (JP) ..... 2006-145764

(51) Int. Cl.
*F15B 13/00* (2006.01)

(52) U.S. Cl. ..... 137/269; 137/271; 137/625.64; 137/884

(58) Field of Classification Search ..... 137/269–271, 137/596.16, 625.64, 625.69, 884; 251/25, 251/26, 129.15
See application file for complete search history.

(56) References Cited

U.S. PATENT DOCUMENTS 3,215,158 A * 11/1965 Bass, Jr. et al. ..... 137/269
3,504,704 A * 4/1970 Beckett et al. ..... 137/625.64
5,522,431 A * 6/1996 Bonacorsi et al. ..... 137/884
5,529,088 A * 6/1996 Asou ..... 137/271
5,699,834 A * 12/1997 Hayashi et al. ..... 137/884
5,771,918 A * 6/1998 Fukano et al. ..... 137/269
5,860,445 A * 1/1999 Yoshimura et al. ..... 137/269
5,915,409 A * 6/1999 Kaneko et al. ..... 137/270
5,971,022 A * 10/1999 Hayashi et al. ..... 137/625.69
5,988,214 A * 11/1999 Tajima et al. ..... 137/884
6,109,291 A * 8/2000 Yoshimura ..... 137/269
6,155,287 A * 12/2000 Matarai et al. ..... 137/382
6,736,158 B2 * 5/2004 Mack et al. ..... 137/269
6,834,669 B2 * 12/2004 Seyfarth ..... 137/354
2002/0092570 A1 * 7/2002 Miyazoe et al. ..... 137/554

FOREIGN PATENT DOCUMENTS

JP 10-47510 2/1998
JP 2000-283118 10/2000

* cited by examiner

*Primary Examiner*—John Rivell
*Assistant Examiner*—Craig Price
(74) *Attorney, Agent, or Firm*—Oblon, Spivak, McClelland, Maier & Neustadt, L.L.P.

(57) ABSTRACT

To obtain a manifold type solenoid valve assembly in which an solenoid valve which is equipped with an output port and an solenoid valve which is equipped with no output port are mixed and mounted on a common manifold base. On a valve mounting part of the manifold base which has a plurality of the valve mounting parts of the same type, a first solenoid valve which is equipped with an output port for external piping connection is mounted and a second solenoid valve which is equipped with no output port is indirectly mounted through an intermediate block which is indirectly equipped with an output port for the second solenoid valve.

12 Claims, 6 Drawing Sheets

MANIFOLD-TYPE SOLENOID VALVE ASSEMBLY

TECHNICAL FILED

The present invention relates to a manifold type solenoid valve assembly in which a plurality of solenoid valves is mounted on a manifold base.

BACKGROUND ART

Various manifold type solenoid valve assemblies in which a plurality of solenoid valves is mounted on a manifold base which has common fluid flow paths for supplying and discharging have been known as discussed in patent literatures 1 and 2 shown below. The manifold type solenoid valve assembly described in the patent literature 1 uses an solenoid valve equipped with an output port and the manifold type solenoid valve assembly described in the patent literature 2 uses a solenoid valve equipped with no output port, and the output port of the solenoid valve is provided on a manifold base.

The above-described two solenoid valve assemblies are different each other in their structures of the solenoid valves being used. In these solenoid valves, existence of the output ports or the number of flow path holes which are opened on the bonding surface against the manifold base is different. Further, these two solenoid valve assemblies are different each other in the structures of the manifold bases. The solenoid valve assembly equipped with the solenoid valve having no output port is provided with output ports corresponding to each solenoid valve and the solenoid valve assembly equipped with the solenoid valve having the output port is not provided with an output port. Moreover, the number of flow path holes which are opened on the valve mounting surface is different each other. Accordingly, generally, these two solenoid valve assemblies are not compatible each other.

Patent Literature 1: Japanese Unexamined Patent Application Publication No. 2000-283118

Patent Literature 2: Japanese Unexamined Patent Application Publication No. 10-47510

However, depending on the use conditions of fluid pressure equipments, it is often preferred to configure the solenoid valve assembly by mixing the solenoid valve equipped with the output port and the solenoid valve equipped with no output port. In this case, sometimes the above-described two kinds of solenoid valves have to be mounted on the manifold base in an arbitrary order depending on the fluid pressure equipments to be used.

However, so far, it has not been possible to directly mount these two kinds of solenoid valves on a common manifold base. Accordingly, no solenoid valve assembly which meets the above-described requirements has been proposed.

DISCLOSURE OF INVENTION

It is an object of the present invention to provide a manifold type solenoid valve assembly in which both of a solenoid valve equipped with an output port and a solenoid valve equipped with no output port exist. More particularly, it is an object of the present invention to provide a manifold type solenoid valve assembly which is configured to be able to mount the above-described two kinds of manifold type solenoid valve assemblies on a manifold base in an arbitrary order.

To solve the above-described problems, according to an exemplary embodiment of the present invention, a manifold type solenoid valve assembly which includes a manifold base which has a plurality of valve mounting parts for mounting an solenoid valve, a first solenoid valve which is directly equipped with an output port for external piping connection, a second solenoid valve which is not directly equipped with an output port, and an intermediate block which is indirectly equipped with the output port of the second solenoid valve, in which while the first solenoid valve is directly mounted on the valve mounting part, the second solenoid valve is indirectly mounted on the valve mounting part through the intermediate block, is provided.

The manifold base has common fluid flow paths for supplying and discharging which pass through the manifold base in the axis-line direction, and branched holes for supply and discharge which branch from the fluid flow paths and open on each valve mounting part, and the plurality of the valve mounting parts have the same structure each other in the arrangement of the branched holes and in the structure for mounting the first solenoid valve and the intermediate block. Further, the first solenoid valve and the intermediate block have communication holes for supply and discharge which communicate with the branched holes on each bonding surface against the valve mounting part, and by having the same arrangement of the communication holes and the same mounting structure against the valve mounting part on each bonding surface, selectively mountable on any valve mounting surface.

According to an exemplary embodiment of the present invention, at least one of the first solenoid valve and the intermediate block has, on the bonding surface against the valve mounting part, a communication hole for output in addition to the communication holes for supply and discharge, and when the first solenoid valve and the intermediate block are mounted on the manifold base, the communication hole for output can be blocked by the valve mounting part.

Preferably, according to the exemplary embodiment of the present invention, on the valve mounting part of the manifold base, a branched hole for supply which is centrally located and two branched holes for discharge which are located at both ends of the branched hole for supply are opened, and on each bonding surface of the first solenoid valve and the intermediate block, a communication hole for supply which is centrally located and two communication holes for discharge which are located at both ends of the communication hole for supply are opened respectively, and the first solenoid valve and the intermediate block are selectively mountable on the valve mounting parts in 180 degrees opposite directions respectively.

According to the exemplary embodiment of the present invention, the output port of the first solenoid valve can be arranged upward so that an external piping can be connected from a direction of the upper surface of the manifold base, and the output port of the intermediate block can be arranged sidewise so that an external piping can be connected from a direction of the side surface of the manifold base.

Further, according to an exemplary embodiment of the present invention, the intermediate block has an output port on each of the both end surfaces in the longitudinal direction, these output ports communicate with each other, and either of the output ports can be selectively used.

According to an exemplary embodiment of the present invention, it can be possible to obtain a manifold type solenoid valve assembly having an reasonably designed structure in which an solenoid valve equipped with an output port and an solenoid valve equipped with no output port are mounted on a common manifold base and these solenoid valves can be mounted in an arbitrary order depending on fluid pressure equipments.

BEST MODE FOR CARRYING OUT THE INVENTION

Figure 1:
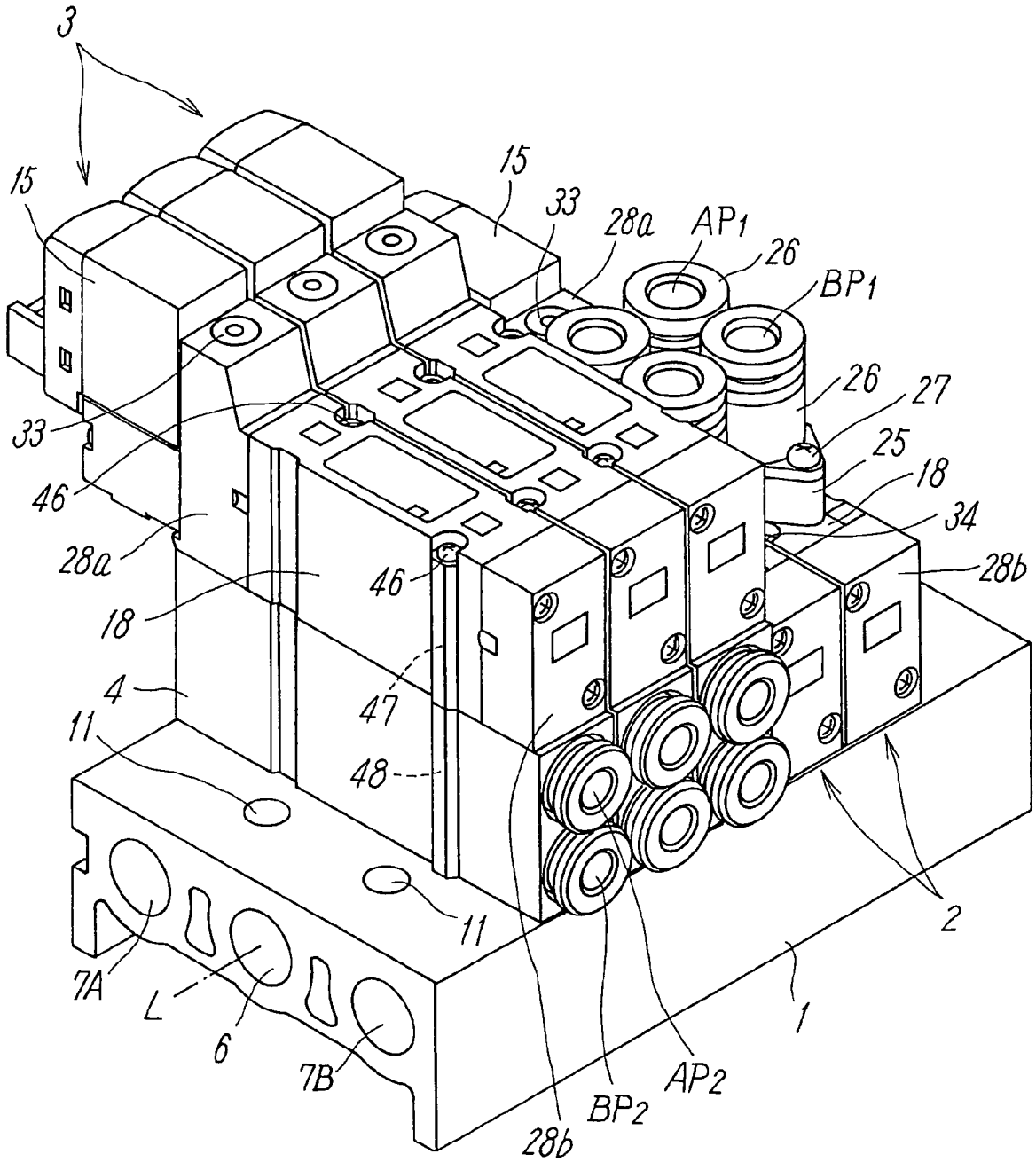
FIG. 1 is a perspective view of a manifold type solenoid valve assembly according to a preferred embodiment of the present invention.

FIG. 1 is a perspective view of a manifold type solenoid valve assembly according to a preferred embodiment of the present invention. This solenoid valve assembly has a manifold base 1, at least one first solenoid valve 2 which is directly equipped with output ports AP1, BP1 for external piping connection, at least one second solenoid valve 3 which is equipped with no output port, and an intermediate block 4 which is indirectly equipped with output ports AP2, BP2 of the second solenoid valve 3. The first solenoid valve 2 is directly mounted on the manifold base 1, the second solenoid valve 3 is indirectly mounted on the manifold base 1 through the intermediate block 4, and thus the solenoid valve assembly is structured.

Figure 2:
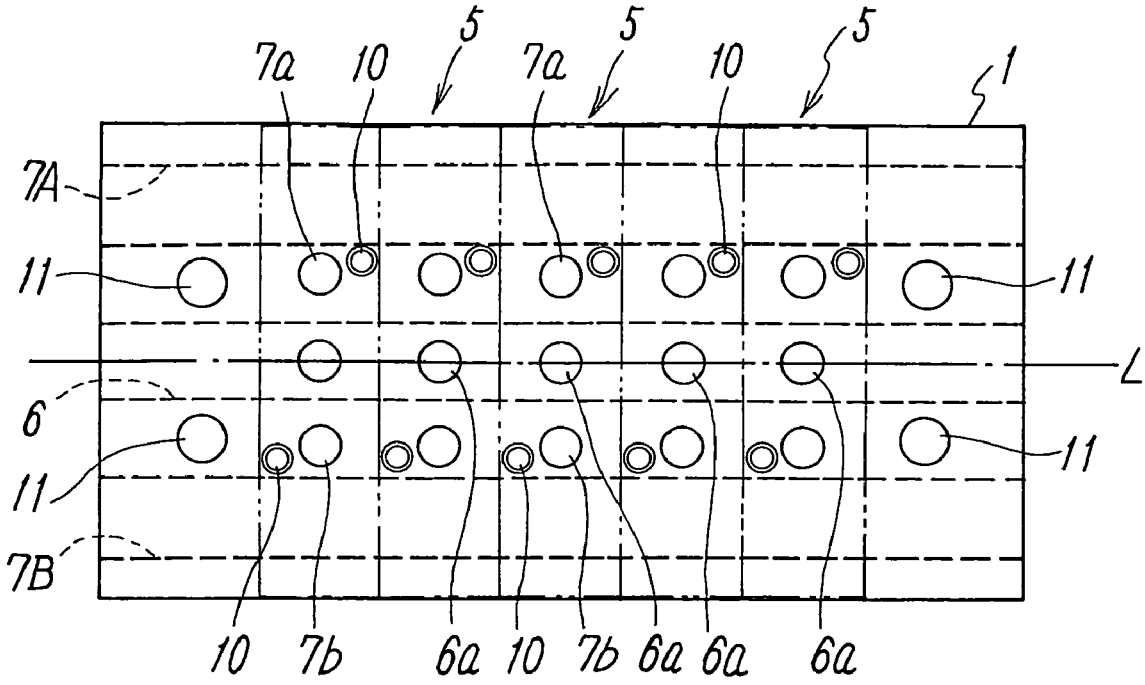
FIG. 2 is a plan view of a manifold base.

The manifold base 1 is a block which is long in one direction whose cross section has a rectangular shape or a substantially rectangular shape and as shown in FIG. 2, on the plane upper surface, a plurality of valve mounting parts 5 for directly mounting the solenoid valves 2, 3 or indirectly mounting the solenoid valve through the intermediate block 4 are provided in parallel. In the manifold base 1, common fluid flow paths for supply and discharge 6, 7A, 7B are provided passing through the manifold base 1 from one end side to the other end side in a longitudinal direction. A plurality of branched holes 6*a*, 7*a*, and 7*b* which branch from the fluid flow paths 6, 7A, 7B are opened on each valve mounting part 5. In FIG. 2, three fluid flow paths are provided; a first fluid flow path 6 for supply which is centrally located, a second fluid flow path 7A and a third fluid flow path 7B for discharge which are located at both sides of the first fluid flow path 6. The first fluid flow path 6 extends along the central axis L through the central position in a widthwise direction (shorter direction) of the manifold base 1. The second and third fluid flow paths 7A and 7B are symmetrically located at both sides of the first fluid flow path 6, and extend in parallel with the first fluid flow path 6.

Accordingly, among the plurality of branched holes 6*a*, 7*a*, and 7*b* which are opened on the valve mounting part 5, the central first branched hole for supply 6*a* communicates with the first fluid flow path 6. The second and third branched holes for discharge 7*a* and 7*b* communicate with the second and third fluid flow path 7A and 7B respectively. Further, these second and third branched holes 7*a* and 7*b* are symmetrically provided at both sides of the first branched hole 6*a* keeping the same distance from the first branched hole 6*a*.

In FIG. 2, a screw hole 10 is used to mount the solenoid valve 2 or the intermediate block 4 on the valve mounting part 5, in the example shown in the drawing, two screw holes 10 are provided on each valve mounting part 5 respectively and further symmetrically provided around the first branched hole 6*a*. A mounting hole 11 is used to mount the manifold 1 on fluid pressure equipment or an installation site around the fluid pressure equipment with a bolt.

The plurality of valve mounting parts 5 has the same structure as that of the branched holes 6*a*, 7*a*, 7*b* and the screw holes 10, and therefore, the solenoid valve 2 and the intermediate block 4 can be selectively mounted on any valve mounting part 5. Further, by symmetrically arranging the branched holes 6*a*, 7*a*, 7*b* in each valve mounting part 5 and the screw holes 10 around the centrally located first branched hole 6*a*, it is possible to selectively mount the solenoid valve 2 and the intermediate block 4 in 180 degrees opposite directions respectively.

Figure 3:
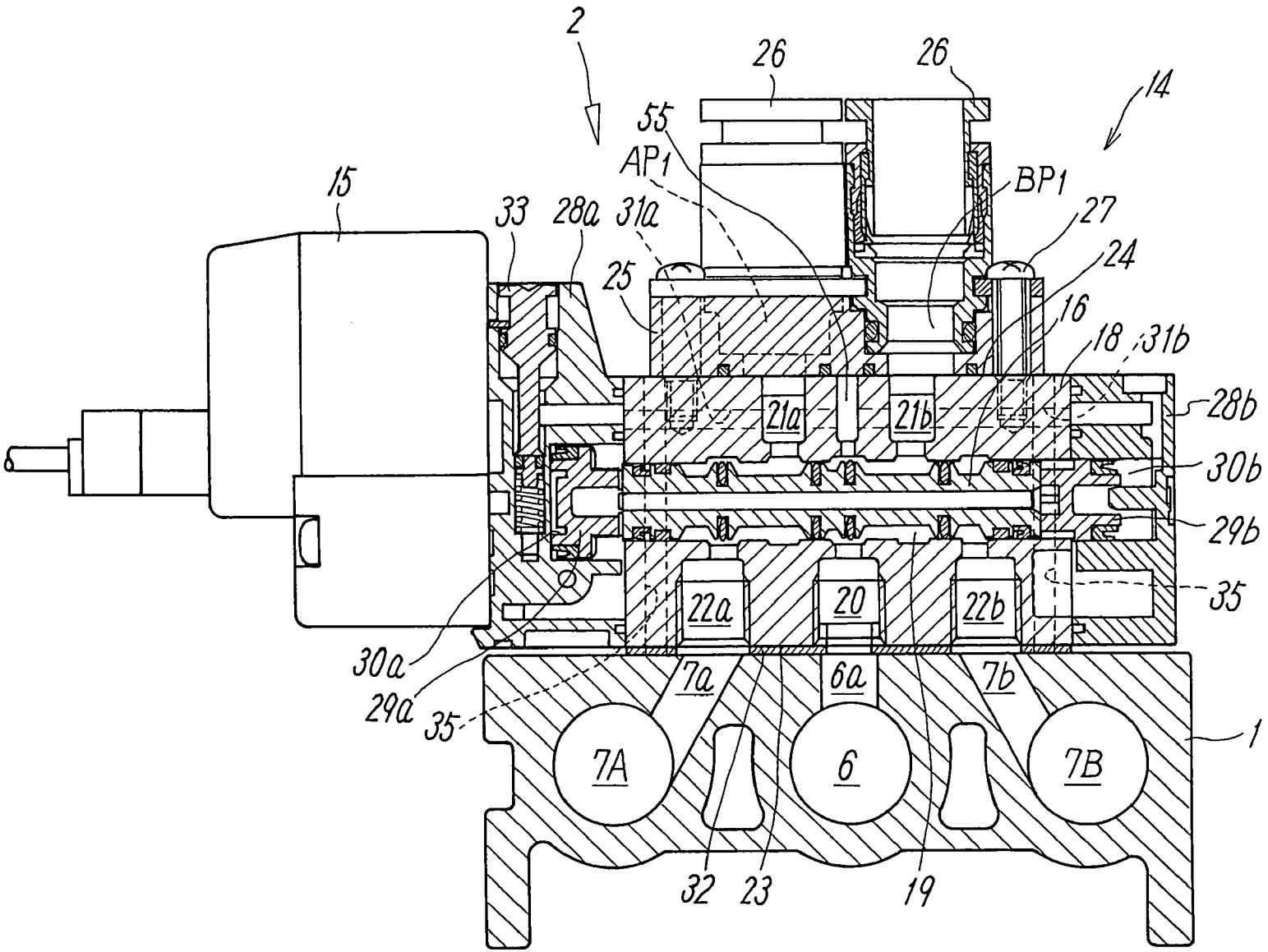
FIG. 3 is a vertical cross-sectional view at the position of the first solenoid valve in FIG. 1.

As shown in FIG. 3, the first solenoid valve 2 is a five-port pilot type solenoid valve, and has a main valve part 14 which houses a spool 16 for flow path switching and an electromagnetic operation type pilot valve 15 which operates the spool 16.

A housing 18 of the main valve part 14 has a longitudinal substantially rectangular cross-sectional shape, a valve hole 19 which extends in the axis-line direction is provided in the housing 18. In the valve hole 19, the spool 16 is slidably accommodated. On the valve hole 19, a communication hole 20 for main fluid supply, two communication holes 21*a*, 21*b* for output which locate at the both sides of the communication hole 20, and communication holes 22*a*, 22*b* for discharge which locate at the both sides of the communication hole 20 are opened. The fluid flow paths among these communication holes are switched by the spool 16.

The under surface of the housing 18 is a rectangular and substantially plane bonding surface 23 for mounting the solenoid valve on one of the valve mounting parts 5 on the manifold base 1. On the bonding surface 23, the above-described three communication holes 20, 22*a*, and 22*b* for supply and discharge are opened in the order that the first communication hole 20 is the center, and the communication holes 22*a*, 22*b* are substantially symmetrically arranged at both sides of the first communication hole 20. When the first solenoid valve 2 is mounted on the valve mounting part 5, these communication holes 20, 22*a*, and 22*b* communicate with the branched holes 6*a*, 7*a*, 7*b* for supply and discharge respectively.

In FIG. 3, a seal member 32 exists between the manifold base 1 and the first solenoid valve 2 to seal around each of the branched holes and communication holes.

The upper surface of the housing 18 is a mounting surface 24 for mounting a port block 25, and on the mounting surface 24, these two output communication holes 21*a* and 21*b* are opened. These communication holes 21*a* and 21*b* communicate with two output ports AP1 and BP1 respectively. These output ports AP1 and BP1 open upward to be connectable with external piping from above. Simple connection pipe joints 26 are connected to these output ports AP1 and BP1 respectively and by simply inserting an external piping made of a synthetic resin etc., it is possible to readily connect the output ports and the pipes. Since the structure of the pipe joint 26 is a well-known structure, further description is omitted.

The port block 25 is detachable by a screw 27, and it is possible to change to other port blocks which are different in sizes of output ports.

To both ends of the housing 18 in the axis-line direction (longitudinal direction), piston covers 28*a*, 28*b* are attached. Between these piston covers 28*a*, 28*b* and the end surfaces of the spool 16, pistons 29*a*, 29*b* are provided respectively. The first piston 29*a* housed in the first piston cover 28*a* is larger in diameter than the second piston 29*b* housed in the second piston cover 28*b*.

On the back surface of each of the piston 29*a* and piston 29*b*, pressure chambers 30*a*, 30*b* are formed between the pistons and the piston covers 28*a*, 28*b* respectively. The first pressure chamber 30*a* on the back surface of the first piston 29*a* having a larger diameter communicates with the communication hole 20 for supply through the pilot valve 15 and a pilot supply hole 31*a*. The second pressure chamber 30*b* on the back surface of the second piston 29*b* having a smaller diameter always communicates with the communication hole 20 for supply through a pilot supply hole 31*b*.

When an electric current is supplied to the pilot valve 15 and a pilot fluid is supplied into the first pressure chamber 30*a*, by a fluid pressure acting force due to a difference between the pressure receiving areas of the larger piston 29*a* and the smaller piston 29*b*, the first piston 29*a* is pressed and the spool 16 moves to the side of the second piston 29*b* having smaller diameter, the supply communication hole 20 communicates with the output first communication hole 21*a*, and a main fluid is output from the first output port AP1. When the electric current to the pilot valve 15 is disconnected, by the pilot fluid in the first pressure chamber 30*a* is being discharged, the spool 16 moves to the side of the first piston 29*a* having larger diameter by the fluid pressure acting force which acts on the second piston 29*b*, the supply communication hole 20 communicates with the second communication hole 21*b*, and the main fluid is output from the second output port BP1.

In FIG. 3, an operation piece 33 is used to reproduce the state that the electric current is supplied to the pilot valve 15 by manual operation, when the operation piece 33 is depressed, the first pressure chamber 30*a* directly communicates with the supply communication hole 20 through the pilot supply hole 31*a*.

In order to fix the first solenoid valve 2 on the valve mounting part 5 of the manifold base 1 with a screw 34, two screw insertion holes 35 are provided to the housing 18. These screw insertion holes 35 correspond to the two screw holes 10 on the valve mounting part 5, and provided to a side surface of one side in the widthwise direction at one end side in the axis-line direction of the housing 18 and a side surface of the other side in the widthwise direction at the other end side in the axis-line direction. Further, the screw insertion holes 35 are arranged so that the solenoid valve 2 can be selectively mounted on any valve mounting part 5 and in any 180 degrees opposite direction.

The first solenoid valve 2 is formed so that the length in the axis-line direction of the main valve 14, that is, the length that the lengths of the housing 18 and the two piston covers 28*a* and 28*b* at both sides are added, is almost the same as the width of the manifold base 1, that is, the length in the shorter direction.

Figure 4:
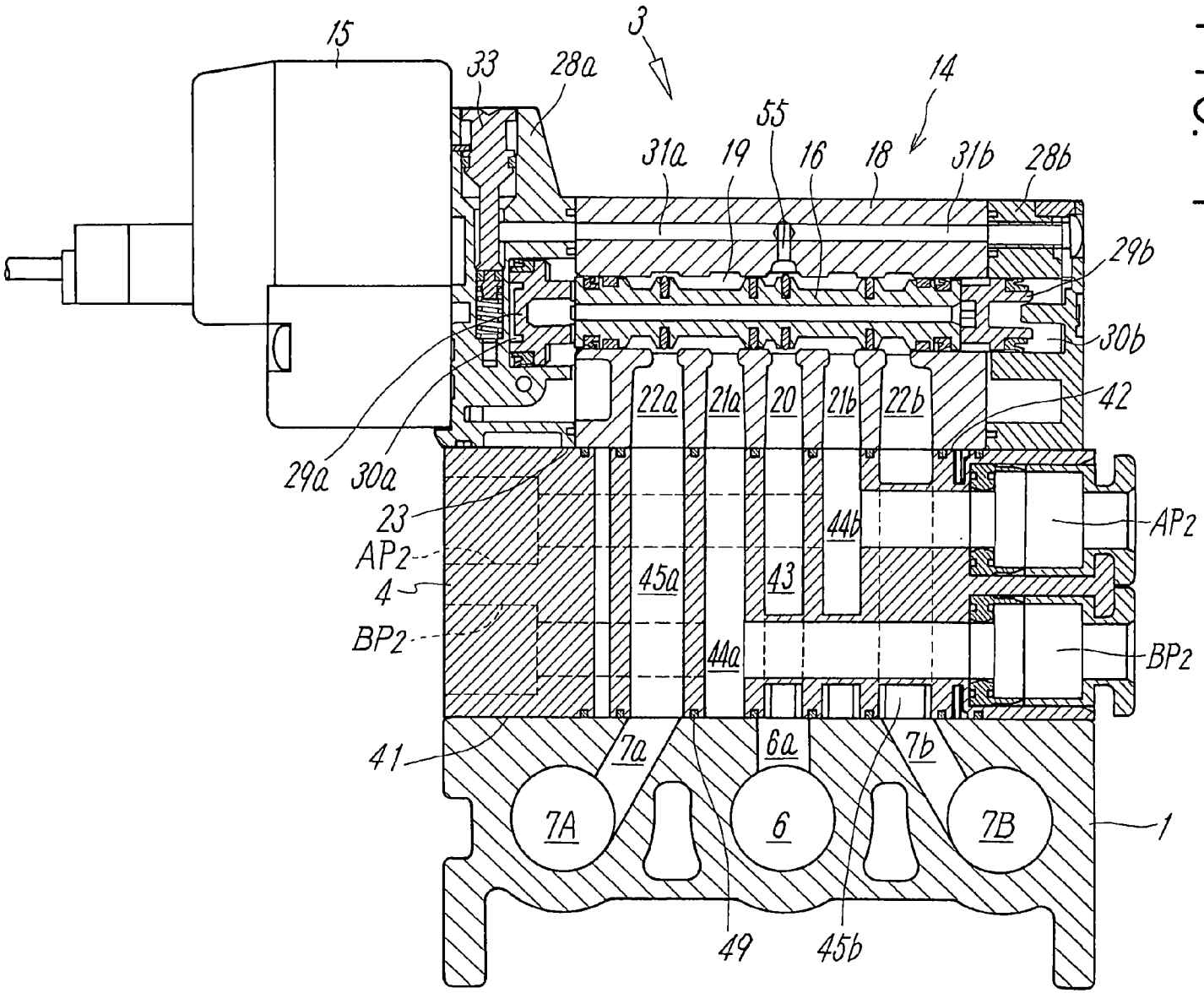
FIG. 4 is a vertical cross-sectional view at the position of the second solenoid valve in FIG. 1.

On the other hand, as shown in FIG. 4, although the second solenoid valve 3 is a five-port pilot type solenoid valve as well as the first solenoid valve 2, differs from the first solenoid valve 2 in that the second solenoid valve 3 is not directly equipped with an output port and in that all of the supply, discharge, and output communication holes 20, 21*a*, 21*b*, 22*a*, 22*b* are opened on the bonding surface 23.

That is, on the bonding surface 23 which is the under surface of the housing 18 in the main valve 14, the five supply, discharge, and output communication holes 20, 21*a*, 21*b*, 22*a*, 22*b* are opened in line in the order that the supply communication hole 20 is the center, the two output communication holes 21*a* and 21*b* are at both sides of the supply communication hole 20, and the two discharge communication holes 22*a* and 22*b* are at both sides of the output communication holes 21*a*, 21*b*.

The structure of the second solenoid valve 3 other than the above-described differences is substantially the same as that of the first solenoid valve 2. Accordingly, the same numbers as the first solenoid valve 2 are applied to essential similar constituent parts and their descriptions are omitted. Also, since working of the second solenoid valve 3 other than the above-described differences is similar to those described above, the description is omitted.

As shown in FIGS. 1 and 4, the intermediate block 4 has a longitudinal and substantially rectangular cross-section. The intermediate block 4 is manufactured by ejection, casting, or the like, the length of the intermediate block 4 is almost the same as that of the width of the manifold base 1, and the width of the intermediate block 4 is almost the same as that of the width of the housing 18 in the second solenoid valve 3. On the under surface of the intermediate block 4, a first bonding surface 41 for bonding onto the valve mounting part 5 of the manifold base 1 is provided, and on the upper surface of the intermediate block 4, a second bonding surface 42 for bonding onto the bonding surface 23 of the under surface of the second solenoid valve 3 is provided. Further, on one end surface in the longitudinal direction of the intermediate block 4, two output ports AP2 and BP2 for outputting the pressure fluid from the second solenoid valve 3 are provided at above and below locations sidewise. To the output ports AP2, BP2, external piping can be connected from the side surface direction of the manifold base 1 sidewise. To the output ports AP2, BP2, simple connection pipe joints can be connected.

These two output ports AP2 and BP2, as shown in FIG. 4 by dotted lines, can be formed on the opposite end surface in the longitudinal direction of the intermediate block 4, can be communicated with corresponding output ports each other, and depending on conditions such as a direction of a piping, the output ports AP2, BP2 of either side can be selectively used. In this case, the unused ports are blocked by plugs or the like.

On the first bonding surface 41 of the under surface of the intermediate block 4, a supply communication hole 43 which communicates with each of the branched hole 6*a*, 7*a*, 7*b* on the valve mounting part 5 and two discharge communication holes 45*a* and 45*b* are opened. These communication holes 43, 45*a*, 45*b* extend upwards in the intermediate block 4 and opened on the second bonding surface 42. Further, these communication holes 43, 45*a*, 45*b* communicate with the supply and discharge communication holes 20, 22*a*, 22*b* of the second solenoid valve 3 respectively. On the second bonding surface 42, in addition to the supply and discharge communication holes 43, 45*a*, 45*b*, two output communication holes 44*a* and 44*b* which communicate with the output ports AP2, BP2 are opened. These output communication holes 44*a*, 44*b* communicate with the output communication holes 21*a*, 21*b* of the second solenoid valve 3 respectively.

These output communication holes 44*a*, 44*b* are located between the supply communication hole 43 and the discharge communication holes 45*a*, 45*b* and further opened on the first bonding surface 41 of the under surface of the intermediate block 4. However, when the intermediate block 4 is mounted on the manifold base 1, the output communication holes 44*a*, 44*b* which are opened on the first bonding surface 41 are blocked by the valve mounting part 5. Accordingly, these output communication holes 44*a*, 44*b* are not necessary to be opened on the first bonding surface 41.

In the drawing, a seal member 49 exists between the manifold base 1 and the intermediate block 4 to seal around each of the branched holes and communication holes.

In order to fix the second solenoid valve 3 and the intermediate block 4 on the valve mounting part 5 of the manifold base 1 with a screw 46, to the housing 18 of the second solenoid valve 3 and the intermediate block 4, screw insertion holes 47, 48 which communicate with each other are provided at two locations respectively. These screw insertion holes 47, 48 correspond to the two screw holes 10 on the valve mounting part 5, and provided to a side surface of one side in the widthwise direction at one end side in the axis-line direction of the housing 18 and the intermediate block 4 and a side surface of the other side in the widthwise direction at the other end side in the axis-line direction. By using a long screw 46 which passes through both screw holes 47 and 48, it is possible to joint fasten to the manifold base 1 and fixed. Further, as well as the first solenoid valve 2, the second solenoid valve 3 and the intermediate block 4 can be selectively mounted on any valve mounting part 5 and in any 180 degrees opposite direction.

Figure 5:
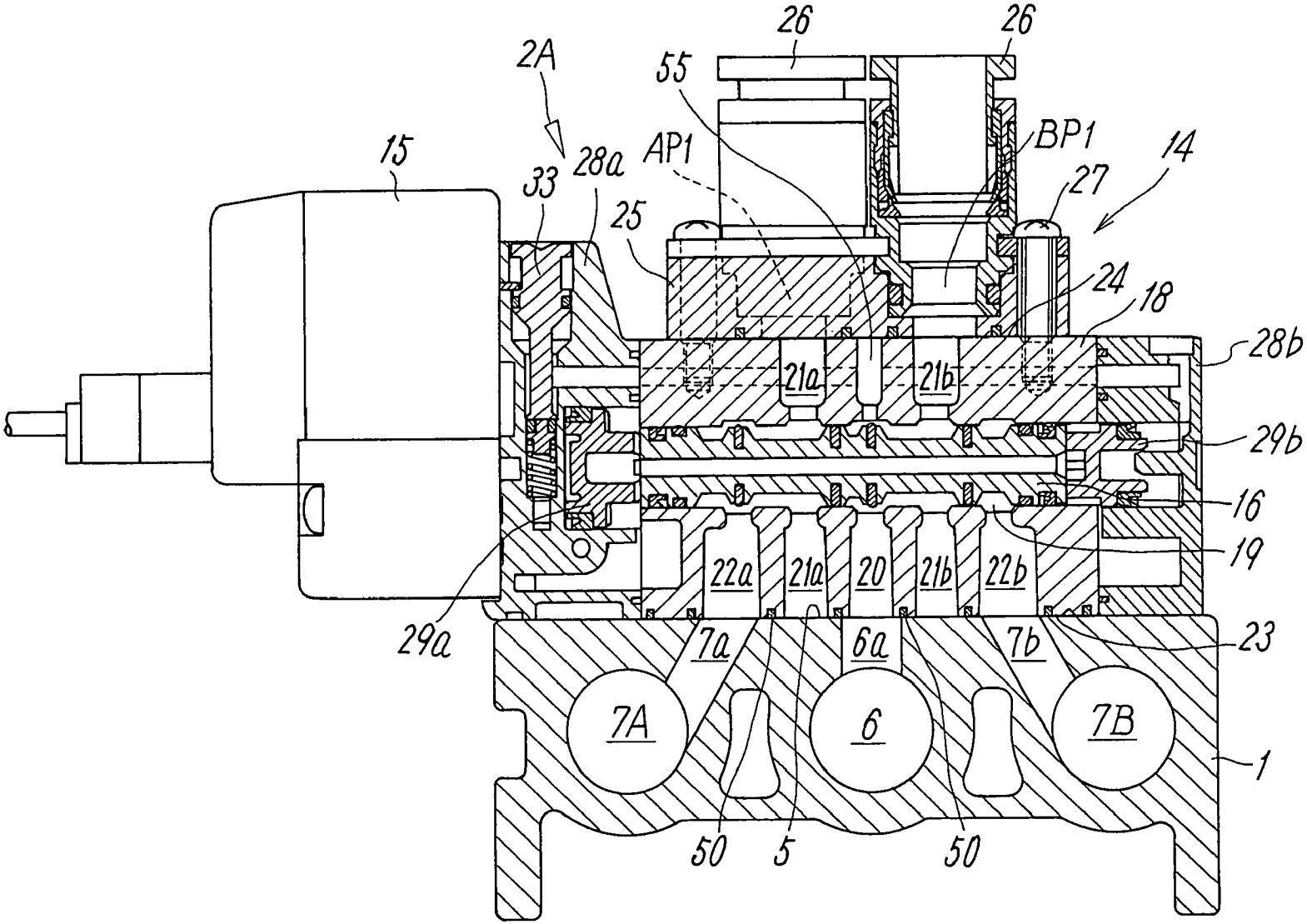
FIG. 5 is a vertical cross-sectional view illustrating an example of different structure of the first solenoid valve.

FIG. 5 illustrates a different structure of the first solenoid valve which is equipped with the output ports AP1, BP1. The differences between a first solenoid valve 2A in FIG. 5 and the first solenoid valve 2 in FIG. 3. are that the two output communication holes 21*a* and 21*b* are opened on the mounting surface 24 on the upper surface of the housing 18 and on the bonding surface 23 on the under surface of the housing 18, and the communication holes 21*a*, 21*b* which are opened on the bonding surface 23 on the under surface are blocked by the valve mounting part 5 of the manifold base 1. On the bonding surface 23, the output communication holes 21*a*, 21*b* are arranged between the supply communication hole 20 and the discharge communication holes 22*a*, 22*b*.

In FIG. 5, a seal member 50 exists between the housing 18 and the manifold base 1 to seal around each of the branched holes and communication holes.

The structure of the first solenoid valve 2A other than the above-described differences is substantially the same as that of the first solenoid valve 2. Accordingly, the same numbers as the first solenoid valve 2 are applied to essential similar constituent parts and their descriptions are omitted. Also, since working of the first solenoid valve 2A other than the above-described differences is similar to those described above, the description is omitted.

Figure 6:
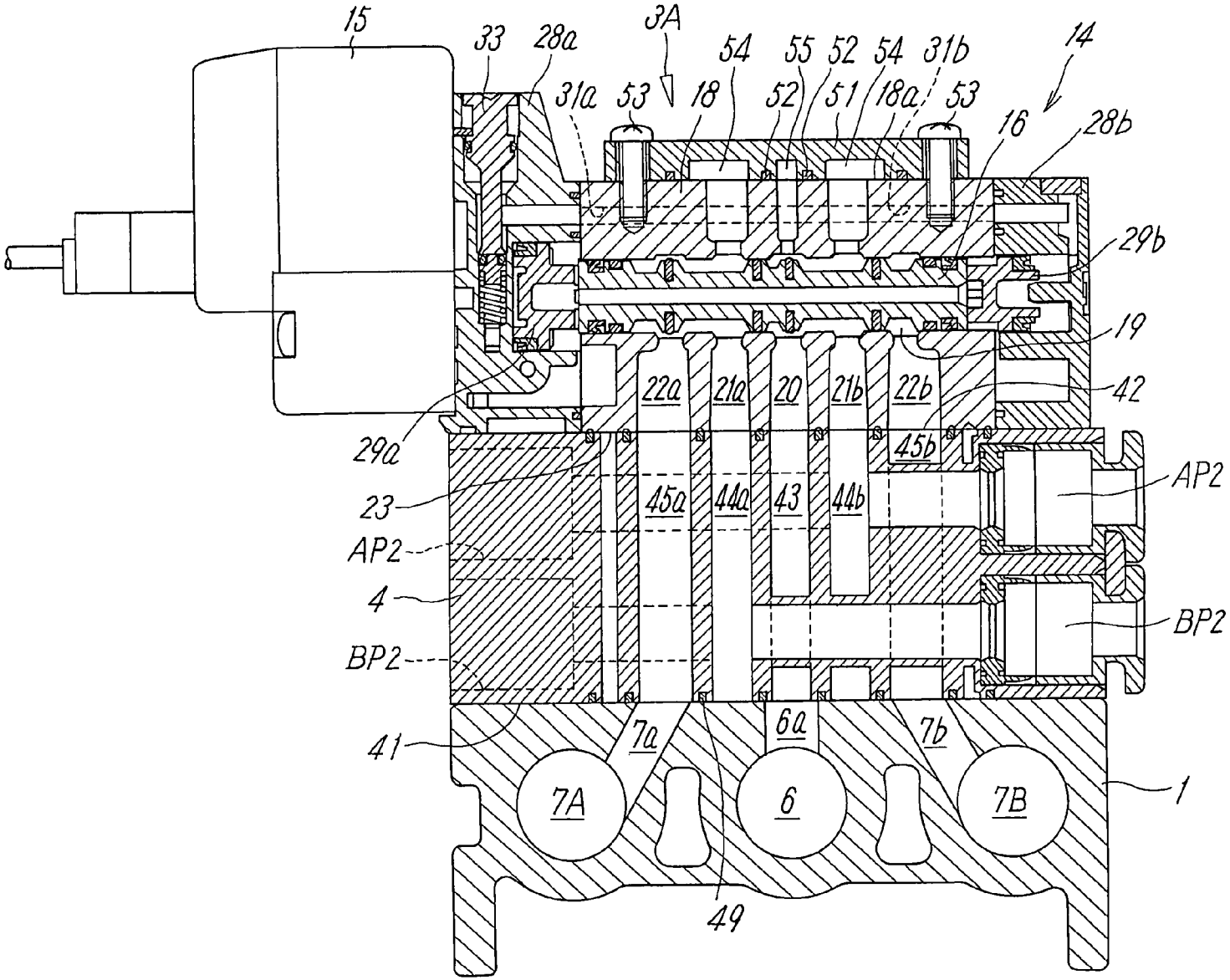
FIG. 6 is a vertical cross-sectional view illustrating an example of different structure of the second solenoid valve.

FIG. 6 illustrates an example of different structure of the second solenoid valve which is equipped with no output port. The differences between a second solenoid valve 3A in FIG. 6 and the second solenoid valve 3 in FIG. 4 are that the two output communication holes 21*a* and 21*b* are opened on both of the bonding surface 23 on the under surface of the housing 18 and upper surface 18*a* of the housing 18, and the communication holes 21*a*, 21*b* which are opened on the upper surface 18*a* are blocked by a cover plate 51 which is mounted on the upper surface 18*a*. In FIG. 6, a seal member 52 exists between the cover plate 51 and the housing 18 and a screw 53 fixes the cover plate 51.

The cover plate 51 is flat-plate shape and has recessed portions 54 at each position corresponding to the communication holes 21*a*, 21*b* on the under surface.

In FIG. 6, a relay hole 55 is opened so that the pilot supply holes 31*a*, 31*b* communicate with the communication hole 20. The relay hole 55 is opened from the upper surface 18*a* side of the housing 18, however, the relay hole 55 is blocked by the cover plate 51.

Such a relay hole 55 is similarly formed on the first solenoid valve 2 in FIG. 3 and the first solenoid valve 2A in FIG. 5 and these openings are blocked by the port block 25. On the other hand, in the second solenoid valve 3 in FIG. 4, the relay hole 55 is formed in a position from the bonding surface 23 side of the under surface of the housing 18 through the supply communication hole 20 to the pilot supply holes 31*a*, 31*b* and the relay hole 55 is not opened on the upper surface of the housing 18.

The structure of the second solenoid valve 3A other than the above-described differences is substantially the same as that of the second solenoid valve 3. Accordingly, the same numbers as the second solenoid valve 3 are applied to essential similar constituent parts and their descriptions are omitted.

Also, since working of the second solenoid valve 3A other than the above-described differences is similar to those described above, the description is omitted.

The first solenoid valve 2A shown in FIG. 5 and the second solenoid valve 3A shown in FIG. 6 have the same structure in the housing 18 of the main valve 14 each other. Accordingly, the structure of the first solenoid valve 2A in FIG. 5 from which the port block 25 is detached and the structure of the second solenoid valve 3A in FIG. 6 from which the cover plate 51 is detached have the same structure and therefore, have compatibility each other.

The manifold type solenoid valve assembly can be structured by using the first solenoid valve 2 in FIG. 3 and the second solenoid valve 3A in FIG. 6. Further, the manifold type solenoid valve assembly can be structured by using the first solenoid valve 2A in FIG. 5 and the second solenoid valve 3 in FIG. 4.

As described above, while the solenoid valves 2, 2A which are directly equipped with the output ports AP1, BP1 and the solenoid valves 3, 3A which are equipped with no output port can be mixed and mounted on the common manifold base 1, and these solenoid valves 2, 2A, 3, 3A can be mounted in an arbitrary order depending on a fluid pressure equipment. Accordingly, it can be possible to obtain the manifold type solenoid valve assembly which has the reasonably designed structure.

In this case, since the intermediate block 4 which has the output ports AP2, BP2 exists between the solenoid valves 3, 3A which are equipped with no output port and the manifold base 1, it is not necessary to specially modify the manifold base 1, the solenoid valves 2, 2A, 3, 3A. Accordingly, by simply providing the intermediate block 4, it can be possible to readily and economically obtain the manifold type solenoid valve assembly using the general-purpose manifold base 1, the solenoid valves 2, 2A, 3, 3A.

In the above embodiment, the first and second solenoid valves are the single-pilot type solenoid valves which have one pilot valve 15. However, at least one of the solenoid valves can be a double-pilot type solenoid valve which has two pilot valves 15. Further, if using the double-pilot type solenoid valve, the diameters of the two pistons 29*a* and 29*b* may be the same.

Further, instead of the five-port type solenoid valve, a three-port type solenoid valve or a solenoid valve which has ports other than the above number of ports can be used. In such case, it is necessary to change the arrangement of the fluid flow paths and the branched holes in the manifold base, the number and arrangement of the communication holes formed on the bonding surface of each solenoid valve or intermediate block etc. depending on the number of the ports.

The invention claimed is:

1. A manifold type solenoid valve assembly comprising:

a manifold base which has a plurality of valve mounting parts for mounting a solenoid valve;

a first solenoid valve which is directly equipped with an output port for external piping connection;

a second solenoid valve which is not directly equipped with an output port; and an intermediate block which is indirectly equipped with the output port of the second solenoid valve; the first solenoid valve being directly mounted on one of the plurality of valve mounting parts and the second solenoid valve being indirectly mounted on another one of the plurality of valve mounting parts through the intermediate block; wherein the manifold base has common fluid flow paths for supply and discharge which pass through the manifold base in an axis-line direction, and branched holes for supply and discharge which branch from the fluid flow paths and open on each valve mounting part, the plurality of the valve mounting parts having the same structure as each other in an arrangement of the branched holes and in a structure for mounting the first solenoid valve and the intermediate block; and the first solenoid valve and the intermediate block have communication holes for supply and discharge which communicate with the branched holes through bonding surfaces against the plurality of valve mounting parts, each bonding surface having a same structure in an arrangement of the communication holes and a mounting structure against the valve mounting parts, thereby making the first solenoid valve and the intermediate block selectively mountable on any valve mounting surface of the manifold base.

2. The manifold type solenoid valve assembly according to claim 1, wherein at least one of the first solenoid valve and the intermediate block has, on the bonding surfaces against the plurality of valve mounting parts, a communication hole for output in addition to the communication holes for supply and discharge, and when the first solenoid valve and the intermediate block are mounted on the manifold base, the communication hole for output is blocked by the valve mounting part.

3. The manifold type solenoid valve assembly according claim 1, wherein on each of the plurality of valve mounting parts of the manifold base, a branched hole for supply which is centrally located and two branched holes for discharge which are located at both ends of the branched hole for supply are opened, and on each bonding surface of the first solenoid valve and the intermediate block, a communication hole for supply which is centrally located and two communication holes for discharge which are located at both ends of the communication hole for supply are opened respectively, and the first solenoid valve and the intermediate block are selectively mountable on the valve mounting parts in 180 degrees opposite directions respectively.

4. The manifold type solenoid valve assembly according claim 2, wherein on each of the plurality of valve mounting parts of the manifold base, a branched hole for supply which is centrally located and two branched holes for discharge which are located at both ends of the branched hole for supply are opened, and on each bonding surface of the first solenoid valve and the intermediate block, a communication hole for supply which is centrally located and two communication holes for discharge which are located at both ends of the communication hole for supply are opened respectively, and the first solenoid valve and the intermediate block are selectively mountable on the valve mounting parts in 180 degrees opposite directions respectively.

5. The manifold type solenoid valve assembly according to claim 1, wherein the output port of the first solenoid valve is arranged upward so that an external piping can be connected from a direction of the upper surface of the manifold base, and the output port of the intermediate block is arranged sidewise so that an external piping can be connected from a direction of the side surface of the manifold base.

6. The manifold type solenoid valve assembly according to claim 2, wherein the output port of the first solenoid valve is arranged upward so that an external piping can be connected from a direction of the upper surface of the manifold base, and the output port of the intermediate block is arranged sidewise so that an external piping can be connected from a direction of the side surface of the manifold base.

7. The manifold type solenoid valve assembly according to claim 3, wherein the output port of the first solenoid valve is arranged upward so that an external piping can be connected from a direction of the upper surface of the manifold base, and the output port of the intermediate block is arranged sidewise so that an external piping can be connected from a direction of the side surface of the manifold base.

8. The manifold type solenoid valve assembly according to claim 4, wherein the output port of the first solenoid valve is arranged upward so that an external piping can be connected from a direction of the upper surface of the manifold base, and the output port of the intermediate block is arranged sidewise so that an external piping can be connected from a direction of the side surface of the manifold base.

9. The manifold type solenoid valve assembly according to claim 5, wherein the intermediate block has an output port on each of the both end surfaces in the longitudinal direction, these output ports communicate with each other, and either of the output ports can be selectively used.

10. The manifold type solenoid valve assembly according to claim 6, wherein the intermediate block has an output port on each of the both end surfaces in the longitudinal direction, these output ports communicate with each other, and either of the output ports can be selectively used.

11. The manifold type solenoid valve assembly according to claim 7, wherein the intermediate block has an output port on each of the both end surfaces in the longitudinal direction, these output ports communicate with each other, and either of the output ports can be selectively used.

12. The manifold type solenoid valve assembly according to claim 8, wherein the intermediate block has an output port on each of the both end surfaces in the longitudinal direction, these output ports communicate with each other, and either of the output ports can be selectively used.

* * * * *